US006752032B2

(12) United States Patent
Yamauchi

(10) Patent No.: US 6,752,032 B2
(45) Date of Patent: Jun. 22, 2004

(54) STARTING APPARATUS FOR AN INTERNAL COMBUSTION ENGINE

(75) Inventor: Hayato Yamauchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/935,709

(22) Filed: Aug. 24, 2001

(65) Prior Publication Data

US 2002/0029644 A1 Mar. 14, 2002

(30) Foreign Application Priority Data

Aug. 28, 2000 (JP) ..... 2000-257439

(51) Int. Cl.[7] ..... F02N 15/02
(52) U.S. Cl. ..... 74/7 C; 74/7 R; 403/348
(58) Field of Search ..... 74/7 A, 7 C, 7 R, 74/7 B; 403/348, 349, 350; F02N 15/02, 15/06

(56) References Cited

U.S. PATENT DOCUMENTS 3,686,961 A * 8/1972 Campbell ..... 74/7 R
4,346,615 A * 8/1982 Yoneda et al. ..... 74/7 A
4,574,648 A * 3/1986 Debello ..... 74/7 A
5,111,706 A * 5/1992 McMillen ..... 74/7 C

FOREIGN PATENT DOCUMENTS

JP 64-56966 3/1989 ..... F02N/15/02

OTHER PUBLICATIONS

Japanese Abstract JP1056966, Jul. 14, 1992.

* cited by examiner

*Primary Examiner*—David Fenstermacher
(74) *Attorney, Agent, or Firm*—Sughrue Mion, PLLC

(57) ABSTRACT

A starting apparatus for an internal combustion engine includes an output shaft rotated by an electric motor and a pinion shaft connected to the output shaft by a one-way clutch. The output shaft is connected to the clutch by a helical spline, and the pinion shaft is connected to a pinion by another helical spline. The splines have the same pitch angle as each other and spiral in a direction opposite to a direction in which the output shaft is rotated by the motor. This structure prevents a locked state in which the pinion can neither engage with or be retracted from a ring gear of an engine to be started.

6 Claims, 3 Drawing Sheets

STARTING APPARATUS FOR AN INTERNAL COMBUSTION ENGINE

REFERENCE TO RELATED APPLICATIONS

This application is based on Japanese Patent Application No. 2000-257439, filed in Japan on Aug. 28, 2000, the contents of which are hereby incorporated by reference.

BACKGROUND OF THE INVENTION

1. Field of the Invention

This invention relates to a starting apparatus for an internal combustion engine having a pinion moving mechanism which can reliably perform engagement and disengagement of a pinion of the starting apparatus with respect to a ring gear of an engine.

2. Description of the Related Art

An internal combustion engine for an automobile, for example, is typically started by engaging a pinion of a starting apparatus with a ring gear of the internal combustion engine and rotating the pinion with an electric starter motor. In order to smoothly carry out starting, it is necessary to perform meshing and disengagement of the pinion and the ring gear with certainty. An example of an arrangement for engaging a pinion of a starting apparatus with a ring gear of an engine is described in Japanese Published Unexamined Patent Application Sho 64-56966. FIG. 6 is a longitudinal cross-sectional view of an example of a starting apparatus disclosed in that publication. In the starting apparatus of FIG. 6, a shaft 1 of an electric motor has a gear 2 mounted thereon for driving a one-way clutch. The one-way clutch includes an outer portion 3, an inner portion 6, and a plurality of rollers 5 which transmit torque between the outer portion 3 and the inner portion 6. The outer portion 3 is equipped with a gear 4 on its outer periphery which engages with the gear 2 mounted on the shaft 1. The inner portion 6 of the one-way clutch is rotatably supported by bearings 7 and 8 mounted in a housing 9.

A pinion shaft 10 is disposed inside the one-way clutch and engages with the inner portion 6 of the clutch through a helical spine 11. A pinion 12 is mounted on the pinion shaft 10 and engages it through a helical spline 13. Helical spline 11 and helical spline 13 spiral in the opposite rotational direction from the direction in which the pinion shaft 10 is rotated by the electric motor (i.e., like a right-hand thread in the example shown in FIG. 6 in which the motor rotates in counterclockwise direction as viewed from the tip of the output shaft), and helical spline 13 has a greater lead angle than helical spline 11. The position of the pinion 12 on the pinion shaft 10 is restricted by a stopper 14 mounted on the pinion shaft 10. A spring 15 for pressing the pinion 12 towards the stopper 14 is disposed between the pinion 12 and a washer 16. A pinion return spring 17 disposed between the inner portion 6 of the clutch and the left end of the pinion shaft 10 urges the pinion shaft 10 and the pinion 12 to the left in the figure. The pinion shaft 10 and the pinion 12 can be shifted to the right in the figure by a shift lever 18 for bringing the pinion 12 into engagement with a ring gear 19 of an unillustrated internal combustion engine.

The starting apparatus of FIG. 6 performs starting operation in the following manner. The shift lever 18 moves the pinion shaft 10 against the force of the pinion return spring 17 towards the ring gear 19, the electric motor is driven to generate a torque limited to a prescribed value, and the pinion shaft 10 and the pinion 12 are driven through the outer portion 3, the rollers 5, and the inner portion 6 of the clutch. The pinion 12 is moved together with the pinion shaft 10 to the right in the figure, and it engages with the ring gear 19. As the pinion shaft 10 and the pinion 12 move to the right, they rotate in accordance with the lead angle of helical spline 11. If the teeth surfaces of the pinion 12 and the ring gear 19 collide without meshing with each other, the spring 15 is deformed by the movement of the pinion shaft 10, so the pinion 12 rotates due to the difference between the lead angles of helical spline 11 and helical spline 13 and completes meshing with the ring gear 19, and with the completion of meshing the electric motor is fully energized and the internal combustion engine is started.

FIGS. 7 and 8 are longitudinal cross-sectional views of another example of a starting apparatus for an internal combustion engine which has been proposed in the past. In this example, a gear 2 which is mounted on a shaft 1 of an electric motor meshes with a gear 21 which is mounted on an output shaft 20. A helical external spline 22 is formed on the output shaft 20. A one-way clutch 23 includes an outer or drive portion 24 which engages with helical spline 22. Torque which is transmitted from the output shaft 20 to the drive portion 24 is transmitted from the drive portion 24 through rollers 25 to an inner or driven portion 26. The driven portion 26 rotates a pinion shaft 27 which is integral with the driven portion 26.

A pinion 29 engages with a straight external spline 28 which is formed on the end of the pinion shaft 27. When the one-way clutch 23 is moved in the axial direction of the pinion shaft 27 by an unillustrated shift lever, the pinion 29 is moved in the axial direction of the pinion shaft 27 while rotating in accordance with the lead angle of helical spline 22, and it engages with an unillustrated ring gear of an engine. A stopper 30 for preventing the pinion 29 from coming off the pinion shaft 27 is mounted on the pinion shaft 27 by a ring 32 in the manner shown in FIG. 8, which is a cross-sectional view of the right end of the pinion shaft 27. A spring 31 presses the pinion 29 towards the stopper 30. Helical spline 22 spirals in the opposite rotational direction from the direction in which the output shaft 20 is rotated by the electric motor.

In the apparatus of FIGS. 7 and 8, when the unillustrated shift lever moves the one-way clutch 23 to the right in FIG. 7, the one-way clutch 23 moves together with the pinion 29 while rotating in accordance with the lead angle of helical spline 22, the pinion 29 engages with the unillustrated ring gear of the engine, and the internal combustion engine is started. If the teeth surfaces of the pinion 29 and the ring gear collide without meshing, the spring 31 is bent by the movement of the pinion shaft 27, the pinion 29 rotates in accordance with the lead angle of helical spline 22 to complete engagement with the ring gear, and when engagement is completed, the electric motor is energized and starts the internal combustion engine.

In the starting apparatus illustrated in FIG. 6, when the pinion 12 is moved in the axial direction of the pinion shaft 10, if the corners of the teeth of the pinion 12 contact the corners of the teeth of the ring gear 19 or a portion of the ring gear 19 which has been damaged during use, when the pinion 12 is further pushed by the shift lever 18, the corners of the pinion 12 bite into the corners or a damaged portion of the ring gear 19, and there are cases in which the pinion 12 cannot rotate in accordance with the lead angle of helical splines 11 or 13. Particularly when the lead angle of helical spline 13 is large, as in the apparatus of FIG. 6, the component of force in the rotational direction with respect to the force in the axial direction is small, so rotation becomes impossible, and there are cases in which meshing of the pinion 12 with the ring gear 19 becomes impossible.

In such a situation, in order to again perform starting operation, if power to the electric motor is turned off, the shift lever 8 returns, and the pinion 12 and the pinion shaft 10 return to their original positions under the pressing force of the pinion return spring 17. This return movement is accompanied by the rotation of the pinion 12 in accordance with the lead angle of helical spline 11 in the same rotational direction as the direction in which the pinion shaft 10 is rotated by the electric motor. Therefore, when, as described above, the corners of the pinion 12 have bit into the corners or a damaged portion of the teeth of the ring gear 19, this rotation becomes impossible, and a locked state takes place in which starting operation and return are both impossible. In the apparatus of FIGS. 7 and 8, the pinion 29 engages with the pinion shaft 27 through the axial spline 28, but the same problem as with the apparatus of FIG. 6 occurs when the corners of the teeth of the pinion 29 have bitten into the corners or a damaged portion of the teeth of the ring gear, and rotation accompanying the lead angle of helical spline 22 cannot take place at the time of return, so both starting operation and return of the starting apparatus to its original state become impossible.

As described above, in the apparatus of FIG. 6, a stopper 14 is provided for preventing the pinion 12 from being pulled off the pinion shaft 10, and in the apparatus of FIGS. 7 and 8, a stopper 30 and a ring 32 are provided at the end of the pinion shaft 27 for the same purposes. During operation of these starting apparatuses, an impact force is applied by the pinion to the stopper 14 or to the stopper 30 and the ring 32. As a result, the stoppers and the ring become worn, and in extreme cases they may fall off the pinion shaft. Particularly in the apparatus of FIG. 6, helical spline 13 is greatly twisted in the opposite rotational direction, so the force which is applied from the pinion 12 to the stopper 14 is large.

SUMMARY OF THE INVENTION

The present invention provides a starting apparatus for an internal combustion engine which can prevent the occurrence of a locked state in which a pinion can be neither engaged with nor retracted from a ring gear of an engine.

The present invention also provides a starting apparatus for an internal combustion engine which reduces the wear of a stopper for restricting movement of a pinion.

The present invention additionally provides a starting apparatus for an internal combustion engine having a stopper for restricting movement of a pinion which can be easily installed.

According to one form of the present invention, a starting apparatus for an internal combustion engine includes an output shaft capable of being rotated by an electric motor and having an external helical spline formed thereon. A pinion shaft has an external helical spline formed thereon, with the helical splines having the same lead angle as each other and spiralling in a direction opposite to a direction in which the output shaft is rotated by the motor. A one-way clutch is connected to the output shaft and the pinion shaft to transmit torque from the output shaft to the pinion shaft. A pinion for driving a ring gear of an internal combustion engine engages with the helical spline of the pinion shaft.

The starting apparatus may include a stopper mounted on the end of the pinion shaft for preventing the pinion from coming off and a first spring which presses the pinion towards the stopper. An elastic member may be provided between the pinion and the stopper for maintaining a gap therebetween.

In one preferred embodiment, a projection having a substantially U-shaped plan configuration is provided on the pinion shaft with its closed end of the "U" being positioned at the end of the pinion shaft and leg portions of the "U" extending in the axial direction, the U-shaped projections defining grooves between them. The stopper is a ring-shaped member having an inner diameter for receiving in it the projections of the pinion shaft and having an inward projection for being permitted to pass through the groove between the U-shaped projections and to enter into the open end of the "U" or the between two leg portions of the "U" on the pinion shaft.

DESCRIPTION OF PREFERRED EMBODIMENTS

Figure 1:
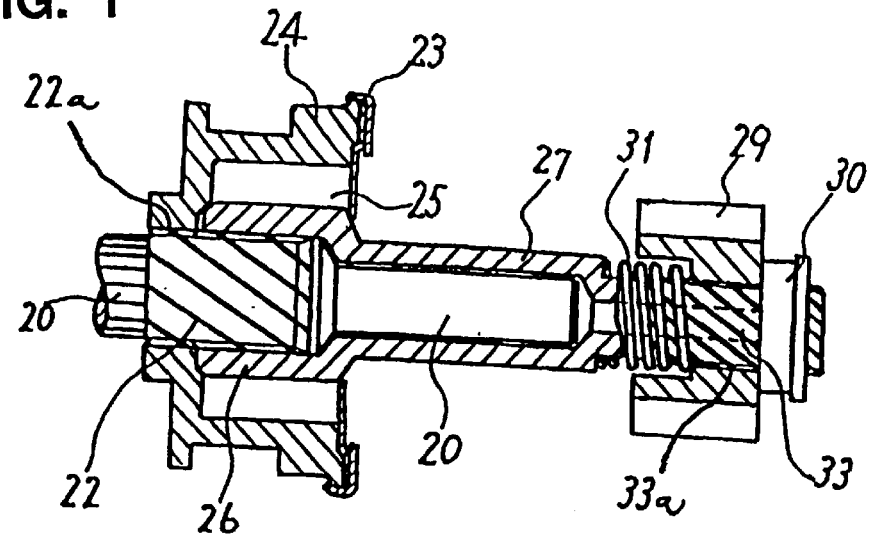
FIG. 1 is a longitudinal cross-sectional view of an embodiment of a starting apparatus for an internal combustion engine according to the present invention.
Figure 7:
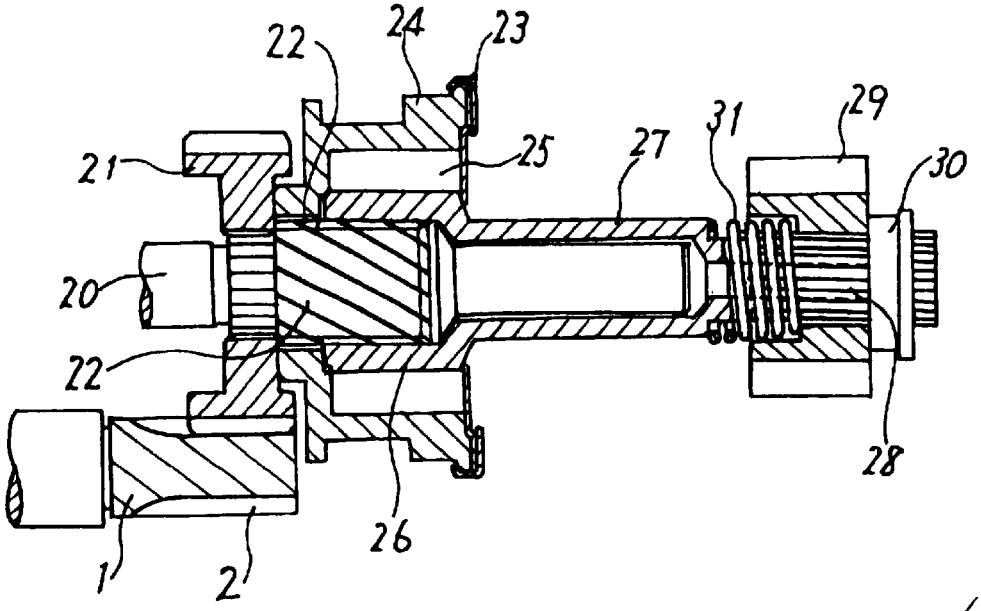
FIG. 7 PRIOR ART
FIG. 7 is a longitudinal cross-sectional view of a portion of another starting apparatus for an internal combustion engine which has been proposed in the past.
Figure 8:
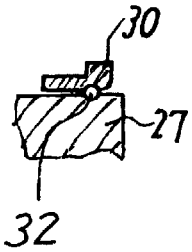
FIG. 8 PRIOR ART
FIG. 8 is a longitudinal cross-sectional view showing how the stopper is connected to the outer end of the pinion shaft in the starting apparatus of FIG. 7.

FIG. 1 is a longitudinal cross-sectional view of a first embodiment of a starting apparatus for an internal combustion engine according to the present invention. An electric motor for powering the starting apparatus has been omitted, and only portions of this embodiment used for moving a pinion are shown. Components corresponding to those in the apparatus of FIGS. 7 and 8 are indicated by the same reference numbers. Like the apparatus of FIG. 7, this embodiment includes an output shaft 20 which is driven by an unillustrated electric motor in the same manner as shown in FIG. 7. A helical external spline 22 is formed on the output shaft 20. A one-way clutch 23 includes an outer or drive portion 24 having an internal helical spline 22*a* which engages with helical spline 22, a plurality of rollers 25 which transmit torque from the drive portion 24, and an inner or driven portion 26 which is driven in only one direction by the rollers 25. A pinion shaft 27 is integral with the driven portion 26. Instead of there being an axial spline 28 as in FIG. 7, a helical spline 33 is formed on the end of the pinion shaft 27 and engages with an internal helical spline 33*a* on the pinion 29.

Helical spline 22 which is formed on the output shaft 20 and helical spline 33 which is formed on the pinion shaft 27 both spiral in the direction opposite to the direction in which the pinion 29 is rotated by the electric motor, and they have the same lead angle. A stopper 30 is mounted on the end of the pinion shaft 27 to limit the movement of the pinion 29 and prevent it from coming off the pinion shaft 27. The pinion 29 is urged towards the stopper 30 by a spring 31.

In the embodiment of FIG. 1, when starting operation is carried out, the output shaft 20 is driven at a torque limited to a prescribed value by the unillustrated electric motor. The drive portion 24 of the one-way clutch 23 is moved together with the pinion shaft 27 which is secured to the driven portion 26 and the pinion 29 by an unillustrated shift lever towards the unillustrated ring gear while rotating in accordance with the lead angle of helical spline 22. When the pinion 29 is moved to a position in which it is nearly completely meshed with the unillustrated ring gear, the electric motor is fully energized, and the internal combustion engine is started.

During the movement of the pinion 29 towards the ring gear, if the corners of the teeth of the pinion 29 are pressed against the corners or a damaged portion of the teeth of the ring gear and meshing of the pinion 29 and the ring gear becomes impossible, the pinion 29 stops in that position. However, helical spline 22 and helical spline 33 have the same lead angle, so even if the rotation of pinion 29 stops, the axial movement of the one-way clutch 23 and the pinion shaft 27 can continue, and when this movement reaches a prescribed position, the electric motor is made to be fully energized and a strong torque acts, so the pinion 29 rotates, and due to the pressing force of the spring 31 which is bent during the period when only the one-way clutch 23 and the pinion shaft 27 are moving, the pinion 29 and the ring gear are made to mesh, and starting of the internal combustion engine is possible.

When a corner of the pinion 29 has bit into a corner of the ring gear and starting operation has not taken place, by canceling starting operation, the unillustrated shift lever is returned to its original position, and with this return operation, the one-way clutch 23 and the pinion shaft 27 also return to their original positions. When the one-way clutch 23 and the pinion shaft 27 rotate in accordance with the lead angle of helical spline 22 during the return movement, helical spline 33 which has the same lead angle as helical spline 22 can rotate even if the pinion 29 is in a state in which it cannot rotate. As a result, the pinion 29 moves in the axial direction without rotating and can be released from biting into the ring gear, it can return to its original position, and restarting is possible, so a locked state does not occur.

Figure 2:
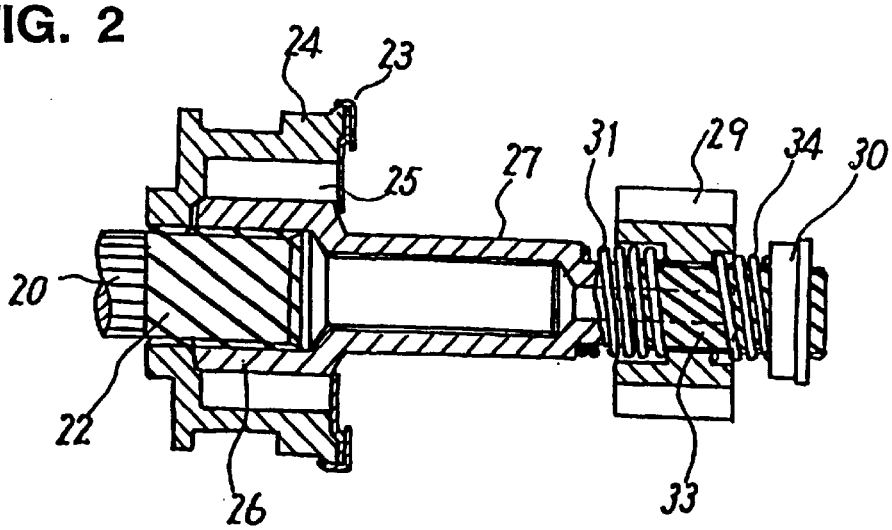
FIG. 2 is a longitudinal cross-sectional view of another embodiment of a starting apparatus according to the present invention.

FIG. 2 is a longitudinal cross-sectional view of another embodiment of a starting apparatus for an internal combustion engine according to the present invention. This embodiment is similar to the embodiment of FIG. 1, but it further includes an elastic member 34 such as a helical spring disposed between the pinion 29 and the stopper 30 for resisting movement of the pinion 29 towards the stopper 30. The forces exerted by the spring 31 and the elastic member 34 are such that during a normal state in which the pinion 29 is free, there is a slight gap formed between the pinion 29 and the stopper 30. The structure of this embodiment is otherwise the same as that of the embodiment of FIG. 1.

With this construction, even if the pinion 29 and the stopper 30 collide with each other due to the relative rotation of the pinion 29 and helical spline 33, the impact force is gradually applied to the stopper 30 by the elastic member 34 and is decreased, so wear of the stopper 30 can be greatly decreased and it can be prevented from falling off of the pinion shaft 27.

Figure 3:
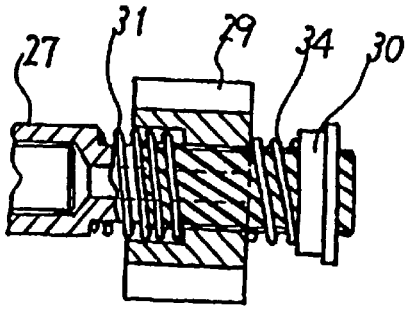
FIG. 3 is a longitudinal cross-sectional view of a modification of the embodiment of FIG. 2.

In FIG. 2, the left end of the elastic member 34 is received in a recess formed in the right side of the pinion 29 so that the pinion 29 contacts the stopper 30 when the elastic member 34 is in a fully compressed state. However, as shown in FIG. 3, which illustrates a variation of the embodiment of FIG. 2, the recess may be omitted so that there is a gap between the opposing surfaces of the pinion 29 and the stopper 30 when the elastic member 34 is in a fully compressed state. This arrangement provides the same benefits as the arrangement shown in FIG. 2.

Figure 4:
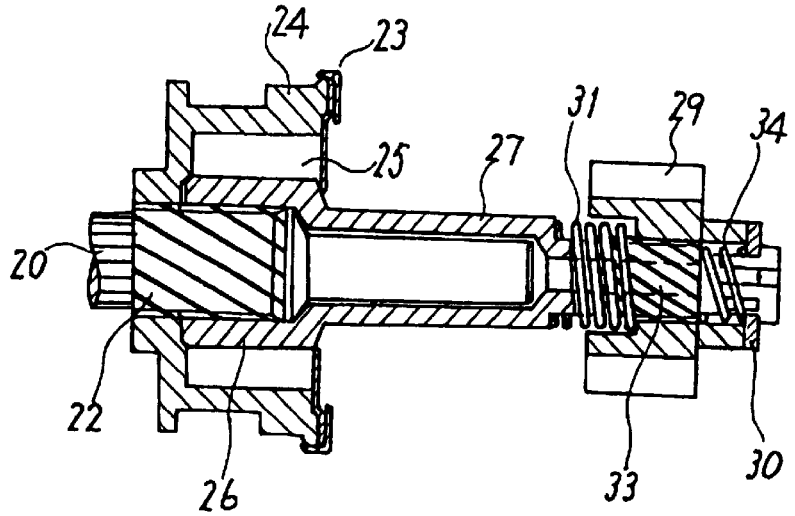
FIG. 4 is a longitudinal cross-sectional view of another embodiment of a starting apparatus according to the present invention.
Figure 5A:
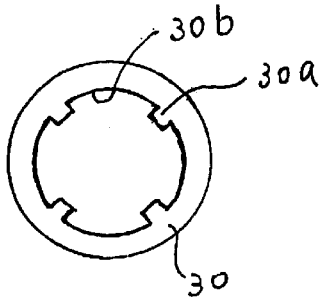
FIG. 5A is a plan view of the stopper.
Figure 5B:
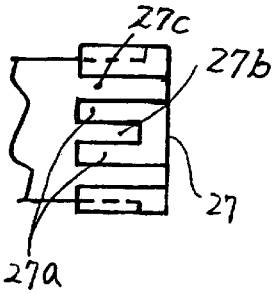
FIG. 5B is a side elevation of the outer end of the pinion shaft of the embodiment of FIG. 4.
Figure 5C:
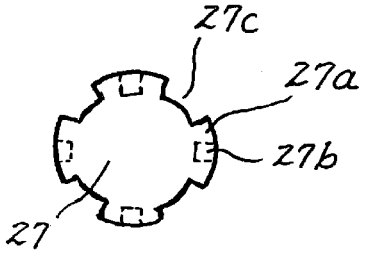
FIG. 5C is an end view of the outer end of the pinion shaft shown in FIG. 5B.

FIG. 4 is a longitudinal cross-sectional view of another embodiment of a starting apparatus for an internal combustion engine according to the present invention, FIG. 5A is a plan view of the stopper of this embodiment, FIG. 5B is a side elevation of the outer end of the pinion shaft thereof, and FIG. 5C is an end view of the pinion shaft shown in FIG. 5B. This embodiment differs from the previous embodiments with respect to the structure of the stopper 30 for maintaining the pinion 29 on the pinion shaft 27. Four projections 27*a* having a substantially U-shaped plan configuration are provided at the end portion of the pinion shaft 27. The bight portion or the closed end of the "U" is on the end of the pinion shaft 27 and the leg portions of the "U" extend in the axial direction. The U-shaped projections 27*a* are circumferentially separated from each other by a grooves 27*c*. The stopper 30 is a ring-shaped member having an inner diameter 30*b* for receiving therein the projections 27*a* on the pinion shaft 27. The inner diameter 30*b* or the inner edge of the stopper 30 is provided four projections 30*a* circumferentially spaced apart by equal distance. The width or the circumferential dimension and height of the projection 30*a* are selected so that it is permitted to pass through the groove 27*c* between the U-shaped projections 27*a* and to enter into the open end of the "U" or the between two leg portions of the "U" on the pinion shaft 27.

Figure 6:
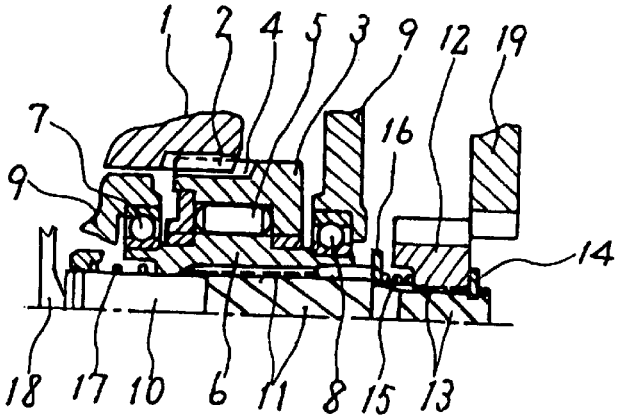
FIG. 6 PRIOR ART
FIG. 6 is a longitudinal cross-sectional view of a portion of a starting apparatus for an internal combustion engine which has been proposed in the past.

When the pinion shaft 27 is to be inserted into the stopper 30, the projections 30*a* of the stopper 30 are slid along the grooves 27*c* between the U-shaped projections 27*a* on the pinion shaft 27 agianst the action of the compression spring 34 until they are positioned beyond the open end of the "U" of the projections 27*a*. Then, the pinion shaft 27 is rotated until the projections 30*a* comes in an axial alignment with the mouth of the open end of the "U" and released under the action of the spring 34 so that the projections 30*a* are elastically pressed against the bottom or closed end of the projections 27*a*, whereby, the stopper 30 is prevented from coming off from the pinion shaft 27. With this structure, compared to the devices shown in FIGS. 6–8, a ring 32 can be omitted, the mountability of the stopper 30 is improved, the contact area with the pinion 29 is increased, and the resistance to wear can be increased.

As described above, a starting apparatus for an internal combustion engine according to the present invention can prevent the occurrence of a locked state in which a pinion of the starting apparatus can neither be meshed with nor retracted from a ring gear of an engine. In addition, the provision of an elastic member between the pinion and a stopper greatly reduces wear of the stopper. Furthermore, the stopper can be mounted on a pinion shaft in a manner which makes the stopper easy to install and increases its resistance to wear.

What is claimed is:

1. A starting apparatus for an internal combustion engine comprising an output shaft configured to be rotated by an electric motor and having an external helical spline formed thereon, a pinion shaft having an external helical spline formed thereon, the helical spline on the output shaft having the same lead angle as the helical spline on the pinion shaft, said lead angle spiralling in a direction opposite to a direction in which the output shaft is rotated by the motor, a one-way clutch connected to the output shaft and the pinion shaft to transmit torque from the output shaft to the pinion shaft, and a pinion for driving a ring gear of an internal combustion engine engaging with the helical spline of the pinion shaft.

2. A starting apparatus as claimed in claim 1 including a stopper mounted on an end of the pinion shaft for preventing the pinion from coming off the pinion shaft, a first spring which presses the pinion towards the stopper, and an elastic member disposed between the pinion and the stopper for maintaining a gap between the pinion and the stopper.

3. A starting apparatus as claimed in claim 2 wherein the first spring is disposed on a first side of the pinion, and the elastic member comprises a second spring disposed on a second side of the pinion.

4. A starting apparatus as claimed in claim 3 wherein the pinion shaft comprises outwards projections, each outward projection having a substantially U-shaped plan configuration defined by two leg portions, an open end, and a closed end; wherein the closed end is positioned at the end of the pinion shaft and the two leg portions extend in the axial direction of the pinion shaft; and wherein the outward projections define grooves therebetween; and wherein the stopper is a ring-shaped member having an inner diameter for receiving therein the outward projections of the pinion shaft and having inward projections corresponding to the outward projections of the pinion shaft, each inward projection configured to pass through one of the grooves between the outward projections of the pinion shaft and to enter into the open end the between the two leg portions of one of the outward projections.

5. A starting apparatus for an internal combustion engine comprising an output shaft configured to be rotated by an electric motor and having an external helical spline formed thereon, a pinion shaft having an external helical spline formed thereon, the helical splines having the same pitch angle as each other and spiraling in a direction opposite to a direction in which the output shaft is rotated by the motor, a one-way clutch connected to the output shaft and the pinion shaft to transmit torque from the output shaft to the pinion shaft, and a pinion for driving a ring gear of an internal combustion engine engaging with the helical spline of the pinion shaft; and a stopper mounted on an end of the pinion shaft for preventing the pinion from coming off the pinion shaft, a first spring which presses the pinion towards the stopper, and an elastic member disposed between the pinion and the stopper for maintaining a gap between the pinion and the stopper; and wherein the pinion shaft comprises outward projections, each outward projection having a substantially U-shaped plan configuration defined by two leg portions, an open end, and a closed end; wherein the closed end is positioned at the end of the pinion shaft and the two leg portions extend in the axial direction of the pinion shaft; and wherein the outward projections define grooves therebetween; and wherein the stopper is a ring-shaped member having an inner diameter for receiving therein the outward projections of the pinion shaft and having inward projections corresponding to the outward projections of the pinion shaft, each inward projection configured to pass through one of the grooves between the outward projections of the pinion shaft and to enter into the open end the between the two leg portions of one of the outward projections.

6. A starting apparatus for an internal combustion engine comprising an output shaft configured to be rotated by an electric motor and having an external helical spline formed thereon, a pinion shaft having an external helical spline formed thereon, the helical spline on the output shaft having the same lead angle as the helical spline on the pinion shaft said lead angle spiralling in a direction opposite to a direction in which the output shaft is rotated by the motor, a one-way clutch connected to the output shaft and the pinion shaft to transmit torque from the output shaft to the pinion shaft, and a pinion for driving a ring gear of an internal combustion engine engaging with the helical spline of the pinion shaft; and wherein an internal helical spline on the one-way clutch is meshed with the helical spline on the output shaft and an internal helical spline on the pinion is meshed with the helical spline on the pinion shaft.

* * * * *